US009767939B2

(12) United States Patent
Hess et al.

(10) Patent No.: US 9,767,939 B2
(45) Date of Patent: Sep. 19, 2017

(54) DISCONTINUOUS SHIELDING TAPE FOR DATA COMMUNICATIONS CABLE

(71) Applicants: Bradley Hess, Sinking Spring, PA (US); Mitch Kopp, Columbia, PA (US); Thomas Aberasturi, Chicago, IL (US)

(72) Inventors: Bradley Hess, Sinking Spring, PA (US); Mitch Kopp, Columbia, PA (US); Thomas Aberasturi, Chicago, IL (US)

(73) Assignee: NEXANS (FR)

( * ) Notice: Subject to any disclaimer, the term of this patent is extended or adjusted under 35 U.S.C. 154(b) by 0 days.

(21) Appl. No.: 14/814,924

(22) Filed: Jul. 31, 2015

(65) Prior Publication Data

US 2017/0032869 A1 Feb. 2, 2017

(51) Int. Cl.
*H01B 11/06* (2006.01)
*H01B 11/10* (2006.01)

(52) U.S. Cl.
CPC ..... *H01B 11/1008* (2013.01)

(58) Field of Classification Search
CPC ..... H01B 11/04; H01B 11/06
USPC ..... 174/36, 113 R
See application file for complete search history.

(56) References Cited

U.S. PATENT DOCUMENTS

| | | | | |
|---|---|---|---|---|
| 3,312,774 A * | 4/1967 | Drinko | H01B 3/004 | 174/107 |
| 3,588,776 A * | 6/1971 | Elwood | H01B 7/32 | 174/115 |
| 7,555,350 B2 * | 6/2009 | MacDonald | A61N 1/056 | 128/908 |
| 2007/0037419 A1 * | 2/2007 | Sparrowhawk | H01B 11/1008 | 439/98 |
| 2009/0223694 A1 * | 9/2009 | Nordin | H01B 11/1008 | 174/34 |
| 2010/0224389 A1 * | 9/2010 | Jenner | B23K 26/0846 | 174/113 R |

* cited by examiner

*Primary Examiner* — Chau N Nguyen
(74) *Attorney, Agent, or Firm* — Sofer & Haroun, LLP

(57) ABSTRACT

A communication cable has a plurality of twisted pair communication elements, a jacket surrounding the twisted pairs and a shield element disposed between the pairs and the jacket. The shield element is constructed as a tape substrate with a plurality of foil shielding elements disposed thereon, the foil shielding elements are formed as at least two longitudinally running strips separated by a horizontal gap. Each of the two longitudinally running strips are further separated periodically with vertical gaps disposed at varied locations with respect to the adjacent longitudinally running strip.

5 Claims, 3 Drawing Sheets

DISCONTINUOUS SHIELDING TAPE FOR DATA COMMUNICATIONS CABLE

BACKGROUND

Field of the Invention

This application relates to a shielding tape. More particularly, this application relates to a shielding tape for LAN (Local Area Network) cables.

Description of the Related Art

LAN or network type communication cables are typically constructed of a plurality of twisted pairs (two twisted conductors), enclosed within a jacket. A typical construction is to have four twisted pairs inside of a jacket, but many other larger pair count cables are available.

Care is taken to construct these cables in a manner to prevent cross talk with adjacent cables. For example, in a typical installation, many LAN cables may be arranged next to one another, and signals in the pairs from a first cable may cause interference or crosstalk with another pair in an adjacent LAN cable. In order to prevent this, the lay length or twist rates of the pairs in a cable are varied differently from one another. Additionally, when pairs in adjacent cables are running parallel to one another the cross talk can be increased so the pairs within a cable are twisted around one another (helically or SZ stranding) to further decrease interference. Spacing elements can also be used so that the jacket is spaced apart from the pairs so that pairs in adjacent cables are as far away as possible.

Nevertheless, despite all of these features, in some cases, the requirements for increased bandwidth may necessitate additional protection from crosstalk. One such common type of protection s shielding. LAN cable shielding is usually in the form of a foil that is wrapped around the pairs inside the cable, under the jacket. This metal foil is usually wrapped around the assembled core of twisted pairs prior to jacketing and is constructed of suitable metals, for example aluminum.

Although the shield is effective for preventing alien crosstalk and other external signal interferences, the shield must be grounded to the connector in order to meet safety regulations. This is a time consuming step that increases the cost to install the shielded cable. One typical example requires a drain wire to be helically coiled around the shield which also increases the overall cable cost.

In the prior art, there have been proposals to mitigate the above effect by providing a discontinuous shielding tape having periodic breaks in the shield.

This design makes sure that any signals that collect in the shield do not extend continuously from end to end of the cable and this obviates the need for grounding the shield. However, in doing so, this design has generated yet another drawback, particularly with respect to the signal quality within the pairs of the cable, owing to interference caused by signals generated by the discontinuous shield elements.

For example, with discontinuous shields, the signals traveling in the pairs can cause induced signals in discontinuous foil elements with the breaks in the shielding giving rise to reflected waves which can create issues with return loss. The patches can collectively interact with the transmitting electrical signals in a cumulative or resonant manner to produce a spike in return loss at a particular frequency of the transmitting signals.

In one example, where the foil size and shape is rectangular with each foil element of the same size and at regular spacing from one another, the generated reflected waves are such that they may occur at one specific frequency, and at significant amplitude.

Other prior art arrangements of discontinuous shields have attempted to minimize the reflected wave that can be created by discontinuous shielding elements of equal length and spacing by varying the length of the shielding elements relative to the length of the foil segments, finding that the frequency/location of the spike may depend upon the sizes of the foil sections and the gap there-between.

Other prior art discontinuous shielding tapes try to minimize the amplitude of the reflected wave by having foil pieces (and breaks) that are not perpendicular to the long edge of the substrate running in the direction of the pairs (i.e. parallelograms).

Although these various arrangements may have some mitigating effect to reduce the amplitude of the reflected waves by increasing the range of frequencies that these reflections occur at, they are still not an optimum solution.

OBJECTS AND SUMMARY

The present arrangement overcomes the drawbacks of the prior art by providing a discontinuous shielding tape, where the conductive shielding elements, disposed on the tape substrate do not form a complete electrical connection from one end of the cable to the other. Moreover, the metal shielding elements have discontinuous spacing arrangements that not only divide the segments longitudinally (along the length of the tape) as with prior art discontinuous shielding tapes but also have the segments simultaneously divided horizontally (across the width of the tape) creating an arrangement with very little or no overlapping/repeating patterns along the length of the tape further reducing or eliminating reflected waves or interference generated therefrom.

To this end, the present arrangement provides a communication cable having a plurality of twisted pair communication elements, a jacket surrounding the twisted pairs and a shield element disposed between the pairs and the jacket.

The shield element is constructed as a tape substrate with a plurality of foil shielding elements disposed thereon, the foil shielding elements being formed as at least two longitudinally running strips separated by a horizontal gap. Each of the two longitudinally running strips are further separated periodically with vertical gaps disposed at varied locations with respect to the adjacent longitudinally running strip.

Such an arrangement maximizes the variation in the segments not only as vertical breaks located along the longitudinal length of the shield tape, but also with horizontal breaks along the entire length of the tape. These varied segment sizes and locations, based on such breaks greatly reduce the amount of reflected wave interference generated by the discontinuous shielding tape.

BRIEF DESCRIPTION OF THE DRAWINGS

The present invention can be best understood through the following description and accompanying drawings, wherein.

DETAILED DESCRIPTION

Figure 1:
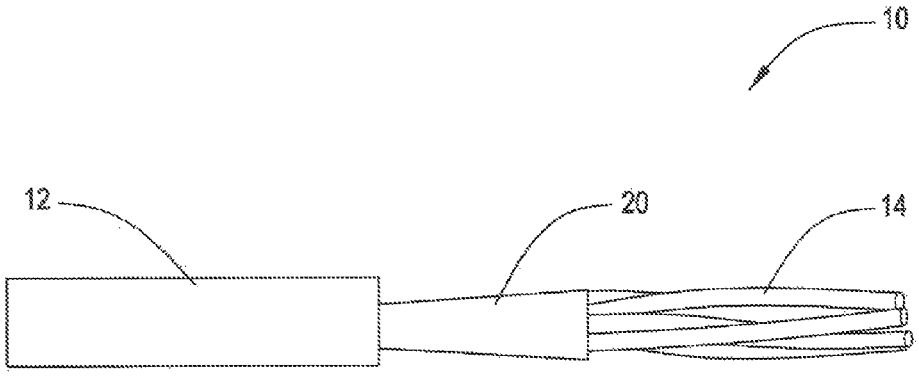
FIG. 1 shows an exemplary four pair LAN cable with a shield showing the general application of the shield, in accordance with one embodiment.
Figure 2:
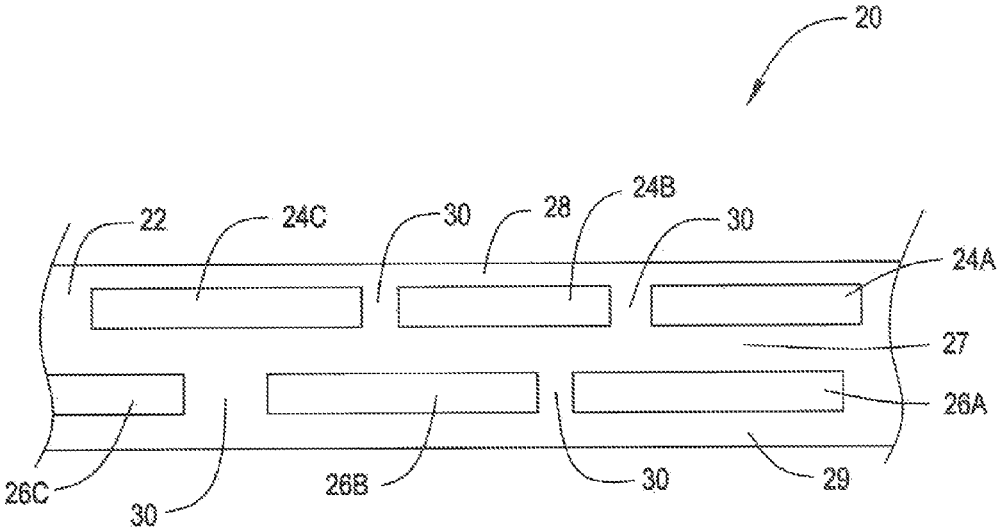
FIG. 2 shows a discontinuous shield tape in accordance with one embodiment.

In one embodiment, FIG. 1 shows an exemplary LAN cable 10 having a jacket 12, a plurality of twisted pairs 14 and a discontinuous shield 20, disposed over pairs 14 within jacket 12. For the purpose of illustrating the salient features of the present arrangement, different versions of discontinuous shielding tape 20, shown in FIGS. 2-3, are envisioned as being applied as shown by element 20 in FIG. 1. However, it is understood that the subsequently described discontinuous shields 20, shown in FIGS. 2-3 may be equally applied to larger or smaller pair count cables, or in other communication cable designs that employ a shield.

Turning to the discontinuous shielding tape 20, FIG. 2, shows a first discontinuous shielding tape 20 constructed of a first substrate 22 and at least two longitudinally running shielding elements 24 and 26.

In a preferred embodiment substrate 22 is typically a thin plastic film composed of any one of polyethylene terephthalate (Mylar™) polypropylene, cellulose acetate butyrate, or other film with sufficient physical properties to survive typical cabling processes. These tapes typically range from 0.001" to 0.005" in thickness and are sometimes flame retardant to improve cable fire test performance. The width of substrate 22 can vary depending on the size of the cable construction being shielded and the method of shield application. Exemplary widths for substrate 22 can range from 0.250" to 3.000".

Regarding the structure of shield elements 24 and 26, such elements can have a wide variety of dimensions depending on the width of substrate 22 and the various desired properties of tape 20. Typically the thickness of foil used for elements 24 and 26 can range anywhere from 0.0005" to 0.0050" depending on the type of external shielding effectiveness required. For an arrangement with elements 24 and 26 on only one side of substrate 22, elements 24 and 26 typically face away from pairs 14 with the non-conductive substrate 22 being in contact with pairs 14. Alternatively, there may be some situations where elements 24 and 26 on substrate 22 are applied to face towards twisted pairs 14 with elements 24 and 26 either being in direct contact with pairs 14 or separated from the pairs 14 by another layer, such as a second layer of non-conductive substrate (not shown).

Regarding the shape of elements 24 and 26, as shown in FIG. 2, they are constructed primarily as longitudinal running strips along the length of tape 20. These elements 24 and 26 are separated by at least one longitudinal gap 27 and may additionally have uncovered (substrate 22 only) longitudinal strips 28 and 30 running along the length of tape 20 on either side.

As shown in FIG. 2, each of elements 24 and 26 are not only separated longitudinally along the length of the tape 20 via gap 27, but each shield element also maintains periodic horizontal breaks 30. In the version shown in FIG. 2 shield elements 24 and 26 are shown segmented into respective elements 24A, 243, 24C, 26A, 263 and 26C, with breaks 30 there-between. As shown, breaks 30 are not lined up symmetrically with one another such that the vertical cross-substrate breaks 30 for each of elements 24 and 26 are spaced in a varied manner along the longitudinal length of substrate 22. The spacing of breaks 30 along the length of substrate 20 is ideally in a pseudo random fashion so as to minimize the amount of repeating patterns.

Breaks 30 may be breaks solely introduced into elements 24 and 26 by cutting or scraping, or they may be openings punched from a rotating punch through which tape 20 is passed before being applied to cable 10. In the case of punching breaks 30 may be full breaks through both elements 24 and 26 as well as substrate 20. Owing to continuous side strips 28 and 29 running along the length of substrate 22, the continuity of tape 20 would not be broken.

Unlike the prior art discussed above, the present arrangement, using shield elements 24 and 26 that have both a longitudinal gap 27 there-between as well as periodic vertical breaks 30 along the length of each element, results in an arrangement here any reflected waves are generated throughout the entire frequency spectrum instead of at repeating isolated frequencies. By doing this, the amplitude of the reflected waves are greatly reduced along the length of cable 10, thus improving the overall performance of the discontinuously shielded cable.

Figure 3A:
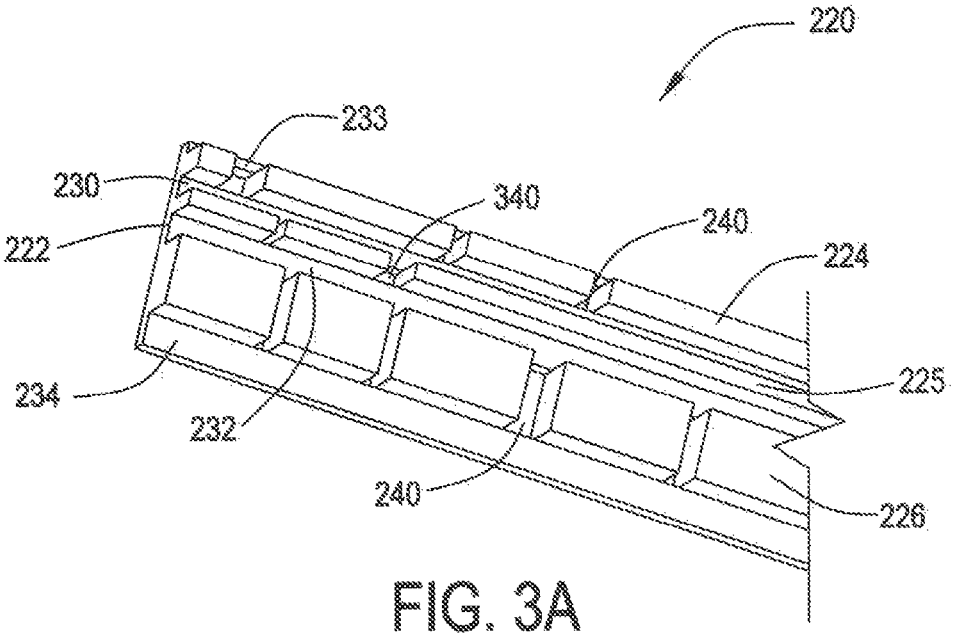
FIGS. 3A-3B show another discontinuous shield tape in accordance with one embodiment.
Figure 3B:
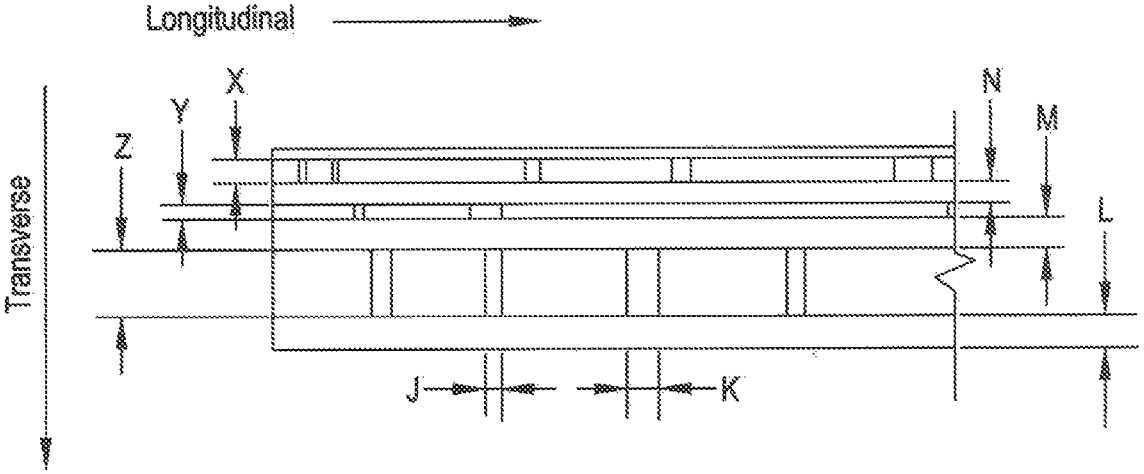

FIGS. 3A and 3B show another tape 220 according to a preferred embodiment. In this case tape 220 is constructed from a similar substrate 222 but with three different longitudinally running shield elements 224, 225 and 226. As shown in FIGS. 3A and 3B, each of shield elements 224, 225 and 226 have different horizontal widths. In this arrangement shield elements 224 and 225 are separated by a first longitudinally running gap 230 and shield elements 225 and 226 are separated by a second longitudinally running gap 232. As with the embodiment shown in FIG. 2, tape 220 has two continuous side strips 233 and 234.

In the arrangement shown in FIG. 3A each of shield elements 224, 225 and 226 further have a series of horizontal breaks 240 that cut through both tape substrate 222 and foil elements 224, 225 and 226, each of which are configured to break shield elements 224, 225 and 226 into longitudinally discrete elements (e.g. 224A, 224B, . . . , 225A, 225B . . . , 226A, 226B . . . ). The width of horizontal breaks 340 may vary in width so that the discrete elements (224A, 224B . . . , 225A, 225B . . . , 226A, 226B . . . ) are separated by varying degrees along the length of substrate 222.

Referring to FIG. 3B, notations "X," "Y," and "Z" are exemplary widths of shield elements 224, 225 and 226 in the transverse direction. It is noted that shield elements 224, 225 and 226 may vary in width depending on the overall width of substrate 222 and the number of longitudinal strips. "M" and "N" refer to the width of longitudinal gaps 230 and 232 in the transverse direction. The widths of gaps "M," and "N" are typically less than metallic strip widths "X," "Y," and "Z" but are not necessarily limited in that respect.

The width "L" refers to the transverse width of side strip 234 of uncoated substrate 222. The widths "J" and "K" are exemplary lengths of gaps 240 in the longitudinal direction and, as illustrated, show varying dimensions along the length of tape 220, unlike gap 230 and 232 in the transverse direction between foil elements 224, 225, and 226 which are substantially constant, the size of breaks 240 along the length of the tape can vary, even between each adjacent gap 240, adding a further dimension of variability to the ultimate foil pattern and making it even less likely to have excessive peak in the spectrum of reflected waves.

In one example of actual dimensions for such elements, if tape 220/substrate 222 is 1 inch in width and there are three longitudinal metallic strips, X, Y, Z could be in the range of 0.1-0.9 inches, with –0.89 inches. J and K would be less than 0.5. L, M, N would fall in the range of 0.01 inches. It is understood that such dimensions, and ratios of dimensions are considered exemplary and in no way are intended to limit the scope of the invention, As with tape 20 shown in FIG. 2, each of elements 224, 225 and 226 are separated along the longitudinal length of substrate 222 via longitudinal gaps 27 that can vary in horizontal width with respect to one another with end running gaps 228 and 299 along the edges of substrate 222. As shown in FIGS. 3A and 3B, and similar to the embodiment shown in FIG. 2, horizontal breaks 300 are interspersed along the length of each shield elements 224, 225 and 226, and different positions. As shown not only does the longitudinal distance between each break 30 change along the length of each element 224, 225 and 226, but such breaks 30 are additionally vertically mis-aligned as well, further reducing the chance of repeating or large reflected waves.

In another embodiment, it is contemplated that a cable arrangement may employ multiple cables each with a discontinuous shielding element according to the above described features. In such an arrangement, it is advantageous to have a one shielding tape on one cable to have a given set of dimensions for its shield/foil elements and gaps there between, with the adjacent cable having a different set of dimensions for its shield/foil elements and gaps there between. Such an arrangement would improve ANEXT (Alien Near End Cross Talk) performance when compared to prior art discontinuous shielded cables as their tapes eventually have patterns of elements that are more likely to repeat after a given distance.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A communication cable, said cable comprising:

a plurality of twisted pair communication elements;

a jacket surrounding said twisted pairs; and a shield element disposed between said pairs and said jacket, wherein said shield element is constructed as a tape substrate with at least two foil elements longitudinally running shielding elements disposed thereon, the foil shielding elements having a longitudinally running gap therebetween, wherein each of said longitudinally running shielding elements are further broken into segments by horizontal breaks cut through both the tape substrate and the foil elements, said horizontal breaks being at periodically spaced locations on said at least two foil elements, where said horizontal breaks on one of said foil elements are disposed at off-set locations relative to another of said at least two foil elements, along the length of each of said foil elements, and wherein said tape substrate of said shield element has two longitudinally running strips one each on either edge of said substrate, that are free from any coverage by said longitudinally running foil elements.

2. The communication cable as claimed in claim 1, wherein said horizontal breaks have different longitudinal widths with respect to one another.

3. The communication cable as claimed in claim 1, wherein said shield element has three longitudinally running foil elements disposed thereon with two longitudinally running gaps therebetween.

4. The communication cable as claimed in claim 3, wherein said three longitudinally running foil elements each have a different width in the transverse direction.

5. The communication cable as claimed in claim 4, wherein said two longitudinally running gaps between said three longitudinally running foil elements have different widths from one another in the transverse direction.

* * * * *